US007024999B2

(12) United States Patent
Muskat et al.

(10) Patent No.: US 7,024,999 B2
(45) Date of Patent: Apr. 11, 2006

(54) WOUND BODY FOR USE AS AN AMMUNITION SHELL

(75) Inventors: Erich Muskat, Roth (DE); Heinz Riess, Furth (DE)

(73) Assignee: Ruag Ammotec GmbH, Furth (DE)

( * ) Notice: Subject to any disclaimer, the term of this patent is extended or adjusted under 35 U.S.C. 154(b) by 0 days.

(21) Appl. No.: 10/296,610

(22) PCT Filed: May 12, 2001

(86) PCT No.: PCT/EP01/05441

§ 371 (c)(1),
(2), (4) Date: Jan. 6, 2003

(87) PCT Pub. No.: WO01/90681

PCT Pub. Date: Nov. 29, 2001

(65) Prior Publication Data

US 2004/0025736 A1 Feb. 12, 2004

(30) Foreign Application Priority Data

May 24, 2000 (DE) ..... 100 25 418
Aug. 9, 2000 (DE) ..... 100 38 751

(51) Int. Cl.
*F42B 5/18* (2006.01)

(52) U.S. Cl. ..... 102/431; 102/465
(58) Field of Classification Search ..... 102/282, 102/431–432, 467
See application file for complete search history.

(56) References Cited

U.S. PATENT DOCUMENTS 707,401 A * 8/1902 Dorr ..... 102/282
2,405,104 A * 7/1946 Mydans ..... 102/282

(Continued)

FOREIGN PATENT DOCUMENTS

DE 20 31 140 A 1/1972

(Continued)

OTHER PUBLICATIONS

The Condensed Chemical Dictionary, Ninth Edition, by Hawley, (1977), Van Nostrand Reinhold Co., New York, NY, pp 614, 615.*

(Continued)

*Primary Examiner*—Michael J. Carone
*Assistant Examiner*—James S. Bergin
(74) *Attorney, Agent, or Firm*—Fulbright & Jaworski L.L.P.

(57) ABSTRACT

According to known techniques for winding an ammunition shell the number of thread layers is often reinforced as compared to the remaining part of the shell wall, especially in those zones of the shell where the load is the highest, thereby, however, inevitably increasing the thickness of the shell wall. If the space for the propelling charge in the wound shell is to be enlarged while the outer geometry of the wound shell remains the same, that is with the same space provided in the weapon for the charge, the wall thickness has to be reduced. In order to provide the shell with the same mechanical stability, despite the reduction in wall thickness, as shells whose wall thickness is not reduced, the wound body of the shell (50) is produced from chemical fibers (53), preferably from synthetic and inorganic chemical fibers.

14 Claims, 2 Drawing Sheets

U.S. PATENT DOCUMENTS

Figure 1A:
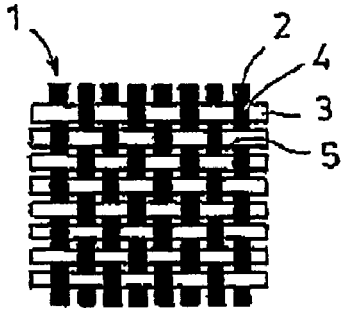

| | | | | | |
|---|---|---|---|---|---|
| 3,176,618 | A | * | 4/1965 | Forsberg et al. | 102/284 |
| 3,304,867 | A | * | 2/1967 | Nadel | 102/282 |
| 3,316,842 | A | | 5/1967 | Schultz | |
| 3,504,630 | A | * | 4/1970 | Picard | 102/43 |
| 3,977,325 | A | * | 8/1976 | Jacobsen et al. | 102/465 |
| 4,505,201 | A | * | 3/1985 | Abele | 102/282 |
| 4,649,827 | A | * | 3/1987 | Brasquies et al. | 102/431 |
| 5,218,166 | A | * | 6/1993 | Schumacher | 102/431 |
| 5,237,928 | A | * | 8/1993 | Redecker | 102/431 |
| 5,243,914 | A | * | 9/1993 | Penner | 102/431 |
| 5,323,707 | A | * | 6/1994 | Norton et al. | 102/431 |
| 5,872,325 | A | * | 2/1999 | Feldmeier et al. | 102/334 |
| 6,523,476 | B1 | * | 2/2003 | Riess et al. | 102/431 |

FOREIGN PATENT DOCUMENTS

| | | | | | |
|---|---|---|---|---|---|
| DE | 198 49 824 | A | | 5/2000 | |
| FR | 2 003 848 | A | | 11/1969 | |
| GB | 6103 | | * | 9/1902 | 102/282 |

OTHER PUBLICATIONS

The Random House College Dictinary, Revised Ed., (1980), Stein (editor), pp. 208, 209, 1334.*

* cited by examiner

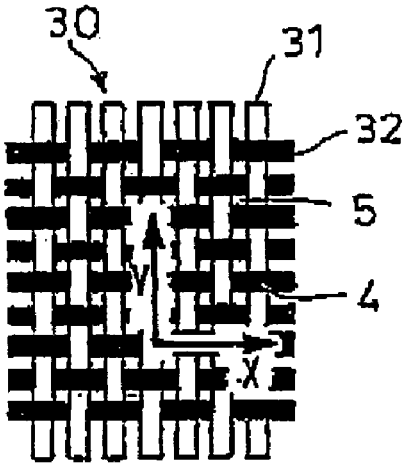
FIG.4
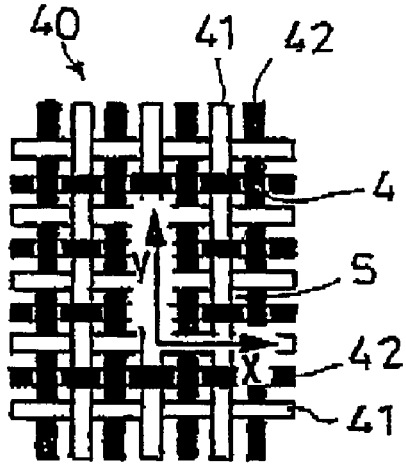
FIG.5
FIG.6
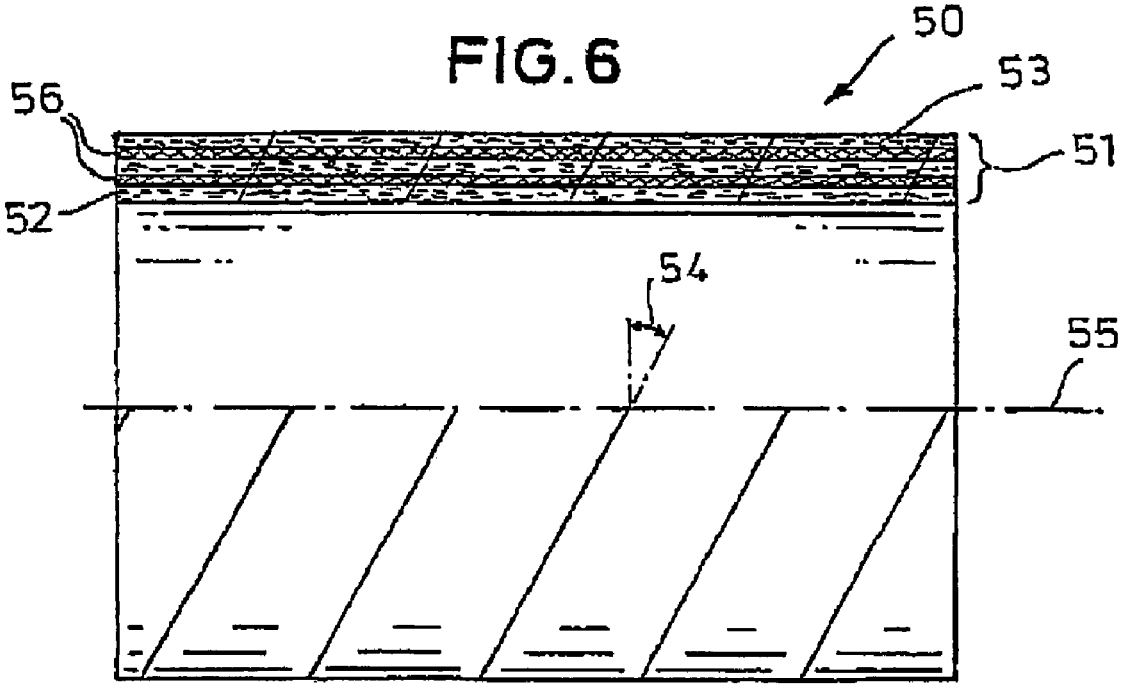

WOUND BODY FOR USE AS AN AMMUNITION SHELL

The invention relates to a casing for ammunition, the wall of the casing comprising a combustible or consumable wound body.

DE 198 49 824 A1 discloses a casing for ammunition in which the wall comprises a combustible or consumable wound body having at least one double layer of crossing threads. The threads are deposited unevenly over the length of the wound body. The winding density, i.e. the number of times the thread(s) is/are deposited over the length of the wound body, is matched to the actual and possible loads and the desired combustion behaviour. For example, the higher the pressure load on a casing in one region, the greater the number of thread layers selected in this region.

A winding technique of this type results in the number of thread layers, particularly in the regions of the casing in which the load is greatest, being greater than the number of thread layers in the remaining part of the casing wall. However, a greater number of thread layers must also result in a thicker casing wall.

However, if the aim is to increase the area for the propellant charge in the wound casing whilst maintaining the same external geometry of wound casing, i.e. the same charge area of the weapon, it is necessary to reduce the wall thickness. Whilst, with a large wall thickness, it is advantageous to use a thread which has a low tensile strength and yet ensures good combustibility or consumability, for example viscose threads, the threads which are generally used do not enable the required mechanical strength of the casing to be achieved when the wall thickness is reduced and the pressure and temperature loads are consequently increased.

An object of the present invention, therefore, is to maintain the strength values of the casing wall with the same external diameter, despite having a smaller wall thickness.

This object is achieved with the aid of the characterising features of the first claim. Advantageous embodiments of the invention are claimed in the subclaims.

According to the invention, the wound body of the casing is made from man-made fibres, preferably synthetic chemical fibres such as polyamide and polyester, and inorganic chemical fibres such as silicate fibres (glass fibres) or carbon fibres. With yarns made from man-made fibres, it is possible to differentiate between monofilament yarns, i.e. filament yarns which are spun from single-hole nozzles and comprise a single thread or a single fibre, and multifilament or polyfilament yarns which are spun from, or composed of, a plurality of threads or fibres. The fibres can also be connected together in a random arrangement to form a non-woven such fibres having a predetermined limited length.

The tensile strength of the fibres used according to the invention is substantially greater than that of fibres made from natural starting materials. For example, the tensile strength of glass fibres as measured in the direction of the fibre is greater than that of steel and is approximately 2500 $N/mm^2$. The tensile strength of carbon fibres, for example, is between 1500 $N/mm^2$ and 3500 $N/mm^2$.

Of the plastics fibres, aramide fibres having a tensile strength of approximately 2000 $N/mm^2$ are particularly suitable. In addition to a high modulus of elasticity, fabrics made from aramide fibres also have extreme impact resistance. The modulus of elasticity of these fibres is approximately $130\times10^3$ $N/mm^2$.

In a further embodiment of the invention, it is also possible for the wound body to be wound from a blend of threads each made from one of the named fibre types. Here, at least two threads of different fibre types can be deposited in a parallel arrangement next to one another in one layer of the wound body. This is possible both when the threads are deposited in parallel on the circumference of the wound body and when the threads are deposited so as to be cross-laid. In order to match the wall thickness of the wound body and its strength in optimum manner, it is thus advantageously possible to use threads of a material having a relatively high tensile strength in those areas where the casing is also subjected to relatively high loads.

The wound body can also be composed of fabric strips instead of individual wound threads. This is advantageous in that the casing wall is wound more easily. Moreover, if a thread tears, there is no risk of a weak point appearing within the casing wall, as occurs at the tear point of individual threads. Furthermore, the winding procedure is completed more quickly. In contrast to depositing individual threads, the winding of fabric is furthermore advantageous in that a fabric strip can be applied to the wound body with a more even stress distribution than one individual thread or a plurality of individual threads next to one another.

Since, when there is pressure in a cylinder, the forces acting tangentially on the circumference of the cylinder are greater than the forces acting on the cylinder wall in the longitudinal direction, it is advantageous for the threads of a fabric which extend substantially in the circumferential direction of the casing to have a higher tensile strength than threads arranged substantially in the longitudinal direction of the casing. It is known that a fabric generally comprises longitudinally extending warp threads and transversely extending weft threads. When winding a fabric, it is useful with reference to the stability of the fabric, for the warp threads to be wound about the casing axis and the weft threads to extend substantially in the longitudinal direction of the casing, for the reasons described above, it is therefore advantageous for the warp threads to be made from a material which has a higher tensile strength than that of the weft threads.

Different fibre types can be processed to form so-called blended or hybrid fabrics. It is thus possible to combine the different properties of the individual fibres in one component. If, for example, carbon and aramide fibres are combined in one fabric, the wound body which is manufactured therefrom and provided with a binding agent is less rigid than a wound body manufactured purely from plastics fibres, and yet has a substantially greater impact resistance.

The properties of a wound body of fabric are furthermore influenced by the thread density and the fabric weave. A fabric in plain weave has a smaller float (narrower curvature) of the threads than a fabric in atlas weave. A greater float results in improved drapability and strength of the wound body as a result of the improved stretch of the threads.

In a further embodiment of the invention, the wound body can comprise at least one layer of a non-woven fabric. A non-woven fabric does not comprise threads but individual fibres of a particular length which are generally oriented irregularly in the non-woven fabric. A non-woven fabric is essentially less strong than a woven fabric although, by selecting the fibres and their arrangement in the non-woven fabric accordingly, this latter can be given such a strength that it suitable for a winding procedure. Unlike a woven fabric, a non-woven fabric has the advantage of being able to absorb a substantially greater volume of liquid substances than a woven fabric. By means of a non-woven fabric, it is thus possible to introduce substances into the wound body which produce propellant gases upon their combustion in addition to the charge.

The strength and cohesion of the wound body is substantially produced by the binding agents, which are either added to the fabric or the non-woven fabric in known manner before the threads are wound, or with which the wound body is saturated after it has been produced. It is also possible to admix an explosive substance with the binding agent in known manner, so that the combustion or consumption of the wound casing is accelerated and additional propellant gases for the projectile are produced. It is already known that the porosity of the thread layers of a fabric influences the combustion or consumption at a wound casing.

Whereas with a wound body manufactured by winding threads, as with a woven fabric, there are spaces between the threads which may be perceived as pores, in the case of a non-woven fabric, pores are not perceivable in such an obvious form. The alignment of the fibres, their length and also the curl are criteria which determine the density of a non-woven fabric and therefore its capacity for receiving filling materials.

Since the non-woven fabric essentially has no open pores, it is particularly suitable not only for absorbing liquid substances but also for fixing during the winding procedure substances which are introduced into the winding gap between an already-wound non-woven fabric layer and the non-woven fabric layer to be wound. It is not necessary here to apply these substances in liquid form. Their consistency must only be such that they can be fixed between the two non-woven fabric layers during the winding procedure.

The invention is explained in more detail with reference to exemplifying embodiments.

As an example of fabric weaves, there is shown:

FIG. 1 a plain weave a) in plan view b) in section

FIG. 2 a twill weave a) in plan view b) in section

Figure 3A:
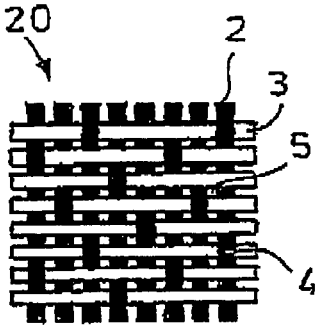
Figure 3B:
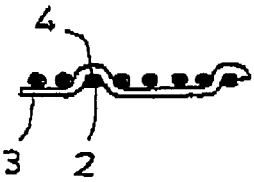

FIG. 3 an atlas weave a) in plan view b) in section

FIG. 4 an example of a blended fabric

FIG. 5 an example of a hybrid fabric and

FIG. 6 an example of a casing the wound body of which has been wound from layers of non-woven fabric.

View a) of FIG. 1 shows a plan view of a fabric 1 in plain weave. The plan view of the differently coloured warp and weft thread shows the typical chequered pattern of a plain weave. The threads 2 shown in dark and also the threads 3 shown in light alternate continuously in terms of their crossing points 4. Between the individual threads, pores 5 remain which can he filled with binding agents or possibly binding agents with added explosive substances. However, they can also be used as air pores in order to provide the necessary combustion air for combustion.

Figure 1B:
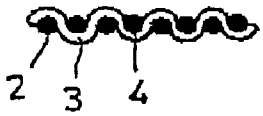

The section through the fabric 1 illustrated in FIG. 1*b*) shows the typical thread course with the strong curvature, float, of the threads determined by the weave.

Figure 2A:
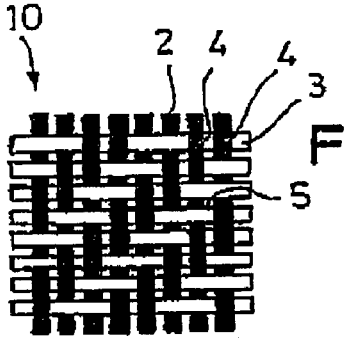

FIG. 2*a*) shows a plan view of a fabric 10 in a so-called twill weave. This type of weave has a diagonal course of crossing points 4 or the threads 3 and 4.

Figure 2B:
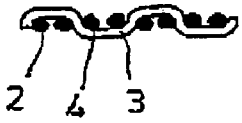

The section through the fabric 10 illustrated in FIG. 2*b*) shows that the float, the curvature of the threads, is wider and the threads thus have a greater stretch.

The threads in the fabric 20 having the atlas weave illustrated in FIG. 3 have an even greater stretch. An atlas weave is produced by the regular distribution of the upward and downward course of the warp thread over the entire weave repeat, so that they do not come into contact at any point. This produces a smooth fabric surface. To this end, at least 5 warp and weft threads are required for each repeat. The repeat is the unit of repetition for a particular thread crossing, or the same figure in the case of patterned textiles or wallpapers. As the plan view of the fabric 20 shows, a crossing point 4 is located only at the intersection with every fourth thread.

FIGS. 4 and 5 show two fabrics which are woven with threads of different fibre materials.

FIG. 4 shows a blended fabric 30 in a plain weave, in which for example the threads 32 extending in the illustrated X-direction are made from carbon fibres, and the threads 31 extending in the Y-direction are made from glass fibres.

FIG. 5 shows a so-called hybrid fabric 40. The threads of different fibres alternate both in the X-direction and the Y-direction. Thus, a thread made from carbon fibres 42 lies next to each thread made from aramide fibres 41.

In the case of blended fabrics and in the case of hybrid fabrics, it is possible to combine the different properties of the individual fibres in one component.

FIG. 6 shows a casing 50 whose wall 51 comprises three layers 52 of a width of non-woven fabric 53 which are wound over one another. This width of non-woven fabric is wound about the axis 53 in three layer 52 with an angle of twist 54. In addition to the bind agent, the non-woven fabric 53 itself can be saturated with explosive substances to promote combustion or consumption.

During the winding procedure, when winding onto the already-present first non-woven fabric layer, it is also possible to introduce a substance between the already-wound non-woven fabric layer and the non-woven fabric layer to be wound. It can also support the weave between the non-woven fabric layers 52. It may also have explosive substances of a different composition, such as that, for example, which is present in the substance with which the non-woven fabric 53 itself is saturated.

The invention claimed is:

1. A casing comprising a wall, said wall comprising a combustible or consumable rigid wound body, said wound body comprising at least one layer comprising at least two man-made threads, wherein said casing is a shell for ammunition and threads deposited on the wound body in a direction of higher load have a higher tensile strength than threads in other directions, wherein threads deposited in different stress directions comprise different materials, and the threads are saturated with a binding agent.

2. A casing according to claim 1, wherein the wound body comprises at least one layer of woven fabric formed from said at least two combustible threads.

3. A casing according to claim 2, wherein said man-made threads comprise warp threads and weft threads of the at least one layer of woven fabric.

4. A casing according to claim 2, wherein said at least one layer of woven fabric has different thread weaves.

5. A casing according to claim 2, wherein an explosive substance is admixed with said binding agent.

6. A casing according to claim 2, comprising at least two layers of non-woven fabric.

7. A casing according to claim 6, wherein a combustion-controlling substance is embedded between said at least two layers of the non-woven fabric.

8. A casing according to claim 6, wherein a substance is embedded between at least two layers of said non-woven fabric, wherein said at least two layerd of non-woven fabric have a composition which is chemically different from that of said binding agent and said explosive substance.

9. A casing according to claim 1, wherein an explosive substance is admixed with said binding agent.

10. A casing according to claim 1, wherein said threads form a fabric and at least one fiber extends substantially in a circumferential direction of the casing and has a higher tensile strength than fibers arranged substantially in a longitudinal direction of the casing.

11. A casing according to claim 1, wherein threads in a substantially circumferential direction of the casing have a higher tensile strength than threads arranged substantially in a longitudinal direction of the casing.

12. A casing according to claim 1, wherein at least one of said at least two threads has a higher tensile strength than at least the other thread and is deposited in the wound body in the direction of the higher load.

13. A casing according to claim 1, wherein the tensile strenth of at least one of said fibers is between 1500 and 3500 $N/mm^2$.

14. A casing according to claim 1, comprising a projectile-receiving portion for receiving a projectile.

* * * * *